US006531514B2

(12) United States Patent
Carney et al.

(10) Patent No.: US 6,531,514 B2
(45) Date of Patent: Mar. 11, 2003

(54) DISPERSANT SLURRIES FOR MAKING SPANDEX

(75) Inventors: Thomas Edward Carney, Waynesboro, VA (US); Oliver Gutsche, Wilmington, DE (US); Kai-Volker Schubert, Chadds Ford, PA (US)

(73) Assignee: E.I. du Pont de Nemours and Company, Wilmington, DE (US)

( * ) Notice: Subject to any disclaimer, the term of this patent is extended or adjusted under 35 U.S.C. 154(b) by 0 days.

(21) Appl. No.: 09/801,136

(22) Filed: Mar. 7, 2001

(65) Prior Publication Data

US 2001/0031791 A1 Oct. 18, 2001

Related U.S. Application Data

(63) Continuation-in-part of application No. 09/525,243, filed on Mar. 15, 2000, now abandoned.

(51) Int. Cl.[7] ..... B01F 17/14; B01F 17/54; B01F 3/12; C09C 1/02

(52) U.S. Cl. ..... 516/34; 106/463; 106/465; 516/33; 516/908

(58) Field of Search ..... 516/33, 34, 908; 106/463, 465

(56) References Cited

U.S. PATENT DOCUMENTS

| | | | | |
|---|---|---|---|---|
| 3,386,942 A | | 6/1968 | Bell et al. | |
| 3,557,037 A | * | 1/1971 | Collins | 516/33 X |
| 3,567,636 A | | 3/1971 | Katzenstein | |
| 3,718,584 A | * | 2/1973 | Beste et al. | 516/33 X |
| 4,525,420 A | | 6/1985 | Imai et al. | 428/372 |
| 5,070,171 A | | 12/1991 | O'Lenick, Jr. | 528/33 |
| 5,149,765 A | | 9/1992 | O'Lenick, Jr. | 528/25 |
| 5,151,218 A | * | 9/1992 | Haubennestel et al. | 516/908 X |
| 5,228,912 A | | 7/1993 | Herget et al. | 106/505 |
| 5,626,960 A | | 5/1997 | Carney | 428/372 |
| 5,785,894 A | | 7/1998 | Schofield et al. | |
| 5,969,028 A | | 10/1999 | Hutte | 524/435 |

FOREIGN PATENT DOCUMENTS

| | | | |
|---|---|---|---|
| EP | 0558758 | 9/1992 | C08L/75/04 |
| EP | 0962560 | 12/1999 | |
| GB | 1169352 | 11/1969 | |
| JP | 63151352 | 6/1988 | |
| JP | 63-151352 | 6/1988 | B01J/13/00 |
| JP | 11-229235 | 8/1999 | |
| WO | WO97/19748 | 6/1997 | B01F/17/00 |
| WO | WO00/09789 | 2/2000 | |

OTHER PUBLICATIONS

Anthony J. O'Lenick Jr. and Jeffrey K. Parkinson, Phosphate Esters: Chemistry and Properties, AATC Journal, 17–20, Nov. 1995.

Robert J. Hunter, Introduction to Modern Colloid Science, Oxford University Press, 294FF., 1993.

* cited by examiner

*Primary Examiner*—Richard D. Lovering
(74) *Attorney, Agent, or Firm*—Robert B. Furr, Jr.

(57) ABSTRACT

A dispersant slurry for making spandex, based on phosphated block poly(alkylsiloxane)-poly(alkyleneether) alcohol or aromatic- or alkylaromatic-terminated phosphated poly(alkyleneether) alcohol dispersants, is provided.

9 Claims, 2 Drawing Sheets

DISPERSANT SLURRIES FOR MAKING SPANDEX

CROSS REFERENCE TO RELATED APPLICATION

This application is a continuation-in-part of application Ser. No. 09/525,243, filed Mar. 15, 2000, now abandoned.

BACKGROUND OF THE INVENTION

1. Field of the Invention

The present invention relates to a dispersant slurry of at least one inorganic particulate, at least one dispersant, and at least one liquid amide and, more particularly, to such a slurry in which the dispersant is a modified phosphated poly (alkyleneether) alcohol.

2. Description of Background Art

Inorganic particulates are used as additives in making fibers, including solution-spun spandex. A variety of such additives are disclosed in U.S. Pat. Nos. 4,525,420, 3,389,942, and 5,626,960 and can be added to the spinning solution in the form of a mixture. Difficulties in filtering such solutions preparatory to spinning and deposits in the spinnerets can arise due to the presence of the inorganic particulates.

European Patent Application 558,758 and U.S. Pat. No. 5,969,028 disclose the use of fatty acids and metal salts of fatty acids as dispersants; however, these are not particularly effective. British Patent 1,169,352 and Japanese Published Patent Application JP63-151352 disclose the use of polyether phosphates, as dispersants for inorganic materials but not in liquids suitable for solution spinning of polyurethanes into spandex.

International Patent Application WO00/09789 and Japanese Published Patent Application JP11-229235 also disclose certain dispersants and selected additives in spandex to impart chlorine registance to polyurethane fibers. Both of these references disclose phosphoric acid esters ("treatment agent") combined with oxides or hydroxides of zinc, magnesium or aluminum. WO00/09789 requires, for producing elastomeric urethane fibers, that the metal particles adhere to the treatment agent. The treatment agent includes polyoxyalkylene glycol alkylene ether acid phosphates, among others. Slurries made with these dispersants are not sufficiently stable, especially at high levels of inorganic particulates.

There is still a need for improvements in spinning spandex containing inorganic additives.

SUMMARY OF THE INVENTION

The dispersant slurry of the present invention consists essentially of (A) 10–78 wt %, based on the total weight of the dispersant slurry, of an inorganic particulate;

(B) 2–50 wt %, based on the inorganic particulate, of a dispersant soluble in the liquid of component (C) selected from the group consisting of (i) phosphated block poly(alkylsiloxane) poly (alkyleneether) alcohols and (ii) aromatic- or alkylaromatic-terminated phosphated poly(alkylene ether) alcohols; and (C) a liquid selected from the group consisting of dimethylsulfoxide, tetramethylurea and amides.

The method of making spandex using the dispersant slurry of this invention comprises the steps of:

(A) milling the slurry so that the particulate has a median particle size no greater than about 5 microns;

(B) adding the slurry to a solution of polyurethane in a spinning solvent; and (C) spinning the mixture from step (B) to form spandex.

DETAILED DESCRIPTION OF THE INVENTION

Figure 1:
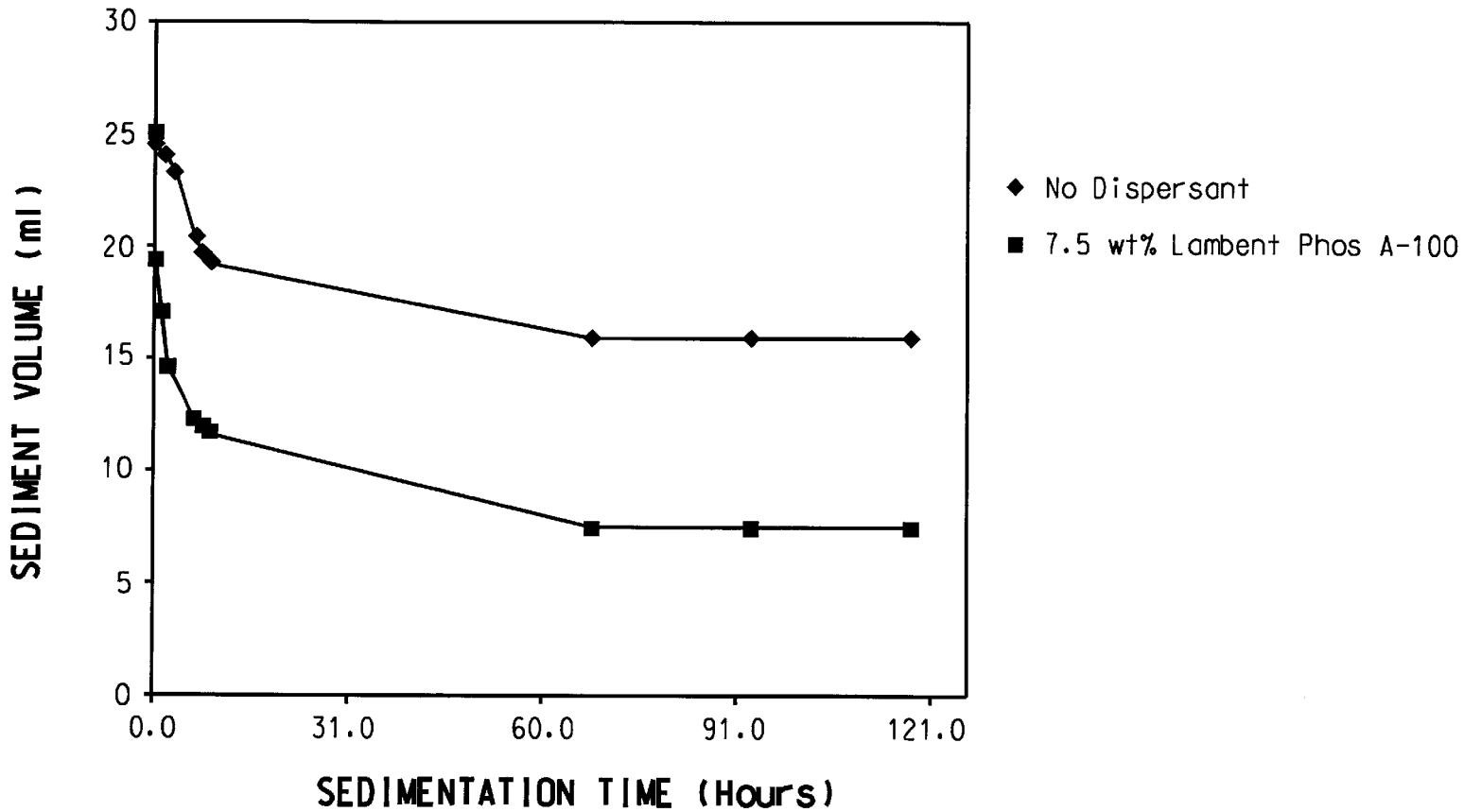
FIG. 1 illustrates the effect of a block copolymer of a phosphated poly(alkyleneether) alcohol with polymethylsiloxane on the sediment volume of a physical mixture of huntite and hydromagnesite in DMAc.

As used herein, "spandex" has its customary meaning, that is, a manufactured fiber in which the fiber-forming substance is a long chain synthetic elastomer comprised of at least 85% by weight of a segmented polyurethane. To make the fiber, a solution of the polyurethane in a suitable spinning solvent is prepared and spun through a spinneret into a column of heated gas (dry-spinning) or into an aqueous bath (wet-spinning) to remove the solvent. The solution is usually filtered before reaching the spinnerets to reduce plugging. "Modified", as applied herein to phosphated poly(alkyleneether) alcohol dispersants and their precursors, means that the dispersant or precursor has an aromatic or alkylaromatic terminal group or a polyalkylsiloxane block. The silicone block of the more preferred dispersants used in making the slurry of the invention is only partially alkylated and contains silanic hydrogens available for grafting polyether blocks; such a silicone block is referred to herein as "polyalkylsiloxane" and its most common form as "polymethylsiloxane".

Solvents suitable for making spandex are generally liquid amides, for example, dimethylacetamide ("DMAc"), N-methyl-2-pyrrolidone ("NMP"), and dimethylformamide. Dimethylsulfoxide (DMSO) and tetramethylurea (TMU) can also be used. A variety of stabilizers (for example, chlorine-resist and anti-tack agents), delustrants, and lubricants can be added to the polyurethane solution before it is spun. Finely divided inorganic particulates can be used as stabilizers, pigments, and delustrants.

The present invention is a dispersant slurry (sometimes referred to as a millbase) comprised of at least one inorganic particulate additive, at least one dispersant and at least one liquid, such as amides, DMSO and TMU. The slurry comprises about 10–78 wt %, typically about 10–70 wt %, inorganic particulate based on total weight of the slurry, and about 2–50 wt %, based on the weight of inorganic particulate, of at least one dispersant. The preferred range is 2–25 wt %.

In order to use smaller equipment and improve milling efficiency while avoiding a rapid rise in slurry viscosity which can make processing difficult, it is preferred that the slurry comprise about 35–70 wt % of inorganic particulate. It was unexpected that a non-aqueous, low viscosity, millable slurry could be made at such high particulate levels.

The inorganic particulate in the mixture can have a median size (based on volume distribution) of about five microns or less and, for improved spinning into fiber, preferably of about one micron or less. When the particle size of the inorganic particulate is ≦1 micron, 4–15 wt % of dispersant is preferred. Such slurries, when milled or otherwise ground and combined with polyurethane spinning solution, can be readily filtered prior to spinning into spandex due to the reduced levels of oversized particles. Deposits on the inside of the spinnerets can also be reduced.

Dispersants useful in making the dispersant slurry and spandex of the invention can be aromatic- or alkylaromatic-terminated phosphated poly(alkyleneether) alcohols and phosphated poly(alkyleneether) alcohols attached to a polyalkylsiloxane backbone as a terminal block or as a comb block. Aromatic-terminated phosphated poly(alkyleneether) alcohols are preferred, and phosphated poly(alkyleneether) alcohols attached to a polyalkylsiloxane backbone as a terminal block or as a comb block are more preferred. In the case of such modified phosphated poly(alkyleneether) alcohols, the precursor polymeric alcohols can be homopolyethers, random copolyethers, or block copolyethers. An example of a precursor homopolyether is poly (ethyleneether) alcohol, and an example of a precursor copolyether is poly(ethyleneether-co-propyleneether) alcohol. Modified phosphated poly(alkyleneether) alcohols can be prepared by the reaction of a correspondingly modified poly(alkyleneether) alcohol (either a monoalcohol or a dialcohol) with polyphosphoric acid, phosphorus oxytrichloride, or phosphorus pentoxide, for example as described in International Patent Application WO97/19748, U.S. Pat. No. 3,567,636 and references therein. The free acid form of the resulting modified poly(alkyleneether) phosphate mono- and di-esters is used; other forms such as the alkali metal salts are generally insoluble in the liquids used with this invention.

The poly(alkyleneether) alcohols which are modified and phosphated to form the corresponding phosphate ester dispersants used in the present invention are sometimes also called oxirane (co)polymers, (co)poly(oxyalkylene) alcohols, ethylene oxide and propylene oxide (co)polymers, or (co)polyalkylene glycols.

The modified phosphated poly(alkyleneether) alcohols can be terminated with aromatic- or alkylaromatic moieties such as phenyl, tristyrylphenyl, nonylphenyl, and similar groups. Termination with, for example, phenyl or tristyrylphenyl groups is preferred. For example tristyrylphenyl-terminated poly(ethyleneether) alcohol phosphate having 16 ethyleneether groups is represented by the formula:

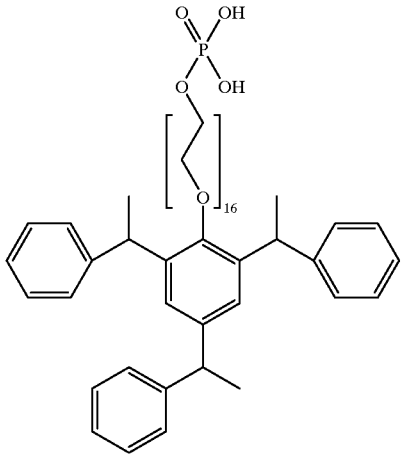

A more preferred form of modified phosphated poly (alkyleneether) used in the present invention is a terminal or comb block copolymer having a silicone backbone, for example of polymethylsiloxane. As described in U.S. Pat. Nos. 5,070,171, 5,149,765, and 5,785,894, such polymers can be prepared by reacting polymethylsiloxanes containing silanic hydrogen(s) with allyl alcohol or an allyl alcohol alkoxylate of the desired polyether to give the block polysiloxane polyether, followed by phosphation with polyphosphoric acid or phosphorus pentoxide. Such preferred dispersants are referred to herein as "phosphated block poly(alkylsiloxane)-poly(alkyleneether) alcohols", and their most common form as "phosphated block poly (methylsiloxane)-trimethylene-poly(ethyleneether) alcohols". The optional "trimethylene" term indicating the link between the blocks created by reaction of allyl alcohol. These dispersants can be represented by the following formulas:

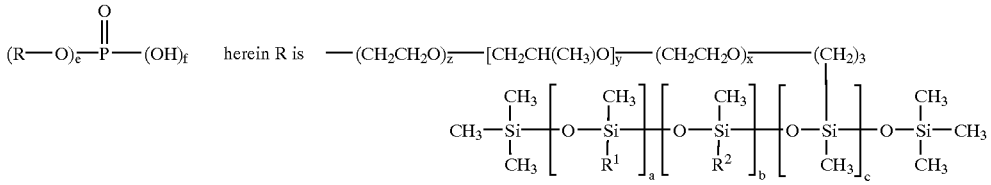

a is an integer from 0 to 200;

b is an integer from 0 to 200;

c is an integer from 1 to 200;

$R^1$ is selected from $—(CH_2)_nCH_3$ and phenyl;

n is an integer from 0 to 10;

$R^2$ is $—(CH_2)_3—(OCH_2CH_2)_x—[OCH_2CH(CH_3)]_y—(OCH_2CH_2)_z—OH$;

x, y and z are integers and are independently selected from 0 to 20; and e and f range from 1 to 2 with the proviso that e+f=3; and

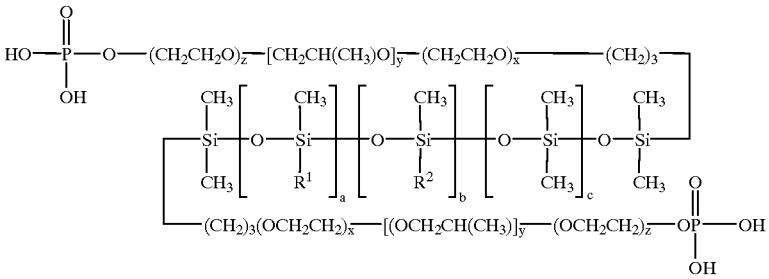

wherein a is an integer from 0 to 200;

b is an integer from 0 to 200;

c is an integer from 1 to 200;

$R^1$ is selected from $—(CH_2)_nCH_3$ or phenyl;

n is an integer from 0 to 10;

$R^2$ is $—(CH_2)_3—(OCH_2CH_2)_x—[OCH_2CH(CH_3)]_y—(OCH_2CH_2)_z—OH$; and x, y and z are integers and are independently selected from 0 to 20.

In the modified phosphated poly(alkyleneether) alcohols useful in the present invention, other moieties can be present, for example in the polyether portion, provided such moieties do not deleteriously affect the slurry, process, and/or spandex of the invention. Such moieties include keto, amide, urethane, urea, and ester groups.

Inorganic particulates that can be used in the dispersant slurry of the present invention include carbonates (e.g., magnesium carbonate, calcium carbonate, barium carbonate, and complex carbonates such as hydrotalcite and a physical mixture of huntite, $Mg_3Ca(CO_3)_4$, and hydromagnesite, $Mg_4(CO_3)_4 \cdot Mg(OH)_2 \cdot 4H_2O$, sulfates (e.g., barium sulfate and calcium sulfate), hydroxides (e.g., magnesium hydroxide and calcium hydroxide), and oxides (e.g., silicates, aluminum oxide, magnesium oxide, titanium dioxide, and zinc oxide). The hydrotalcite can be synthetic or naturally occurring and has the general formula $M^{2+}{}_xAl_2(OH)_{2x+6-nz}(A^{n-})_z \cdot mH_2O$, wherein M is Mg or Zn, x is a positive integer of at least 2, z is a positive integer of 2 or less, m is a positive integer, and $A^{n-}$ is an anion of valence n. Examples of hydrotalcites useful in the present invention include $Mg_{4.5}Al_2(OH)_{13}CO_3 \cdot 3.5H_2O$, $Mg_6Al_2(OH)_{16}CO_3 \cdot 4H_2O$, $Mg_8Al_2(OH)_{20}CO_3 \cdot 3.6H_2O$, $Mg_{4.7}Al_2(OH)_{13.4}CO_3 \cdot 3.7H_2O$, $Mg_{3.9}Al_2(OH)_{5.8}CO_3 \cdot 2.7H_2O$, and $Mg_3Al_2(OH)_{10}CO_3 \cdot 1.7H_2O$.

Liquid amides that can be used in this invention include DMAc, NMP, and dimethylformamide.

The dispersant slurry is prepared by mixing together and, then, optionally milling or grinding, at least one of a liquid amide, TMU and DMSO, at least one inorganic particulate, and at least one dispersant. The slurry can also contain other additives.

The slurry ingredients can be mixed in any order, but it is preferred either that the dispersant first be mixed with the liquid and then the inorganic particulate be added, or that the dispersant first be mixed with or coated onto the inorganic particulate and then the liquid be added. First mixing the liquid with the inorganic particulate can result in undesirably high initial viscosity, at least until the dispersant is added.

Optionally, the slurry can be diluted, or let down, with additional liquid amide and/or a solution of polyurethane in amide. The let down slurry can then be mixed with additional polyurethane solution and other additives to form a so-called polyurethane spinning solution, which is then dry- or wet-spun to form spandex containing about 0.1–10 wt % inorganic additive, based on the weight of the fiber. For example, about 0.5 wt %, based on the weight of spandex, of a physical mixture of huntite and hydromagnesite can be used.

Unless otherwise noted, the dispersants tested in the Examples were used neat or nearly neat; however, other materials can be present in the dispersant if such materials do not adversely affect making, processing, and using the dispersant slurry or the resulting spandex. Commercial phosphated polyether alcohols used in the Examples were complex mixtures of monoester, diester, unreacted phosphoric acid, and unphosphated polyether alcohol (AATCC Journal, November 1995, pp 17–20). Lambent Phos A-100, a block polymethylsiloxanetrimethylene-polyethyleneether alcohol phosphate, is a comb polymer having a plurality of polyethyleneether groups as the teeth of the comb, and about 40% of the hydroxyl groups in each block copolymer molecule are phosphated, 5–8% being monoester, 26–33% being diester, and the remainder of the hydroxyl groups on the polyethyleneether teeth are substantially unreacted (nonionic) moieties. Less than 1% of Lambent Phos A-100 is phosphoric acid.

The inorganic particulate materials used in the Examples were as follows; all references to particle size are based on volume distribution:

Ultracarb® U5: Microfine Minerals, Ltd. An approximately 50/50 weight ratio of huntite and hydromagnesite, having median particle size of 5 microns.

Ultracarb® UF: Microfine Minerals, Ltd. Similar to Ultracarb® U5 but has a median particle size of 1 micron with particle agglomerates having a median size of 30 microns.

Ultracarb® UF, air milled: Ultracarb® UF which has been processed through an air jet mill to break up agglomerates. Median particle size of about 1 micron.

Mag®Chem BMC-2: Martin Marietta Magnesia Specialties, Inc. High purity, highly reactive basic magnesium carbonate powder, $Mg_5(CO_3)_4(OH)_2 \cdot 4H_2O$. Particle size, 1.5 microns.

Mag®Chem 50M: Martin Marietta Magnesia Specialties, Inc. Light burned magnesium oxide, having a median particle size of 1 micron.

R902 DuPont: Titanium dioxide median particle size 0.42 micron.

Kadox® 911: E. W. Kaufmann Co. Zinc oxide, minimum 99.9% pure, average particle size 0.1 micron.

DHT-4A: Kyowa Chemical Industry Co., Ltd. Synthetic hydrotalcite, $Mg_{4.5}Al_2(OH)_{13}CO_3 \cdot 3.5H_2O$.

Barium Sulfate: Sachtleben Chemie GmbH, Micro grade blanc fixe, 1 micron particle size.

Candidate dispersants were first screened on the basis of solubility in DMAc. Only those that were soluble were examined with regard to their ability to disperse effectively inorganic particulates in the liquids utilized in this invention. Additional tests were then conducted to determine the effectiveness of the dispersants in creating low volume, dense sediments with an inorganic particulate in DMAc after being thoroughly agitated and then allowed to stand. Low sediment volumes are desirable because they indicate that the particles mutually repel each other and are well dispersed, not flocculated or agglomerated, and are therefore able to settle into a well consolidated sediment. (See "Introduction to Modern Colloid Science", Robert J. Hunter, Oxford University Press, 1993, pp. 294ff.)

Unless otherwise noted, sedimentation tests were conducted using dilute mixtures in DMAc of 15 wt % inorganic solids, based on the weight of the DMAc. A sample was vigorously mixed using an IKA Ultra-Turrax T25 Basic Disperser (IKA Works, Inc., Wilmington, N.C.) for 3 minutes at 16,000 rpm (setting 3) using dispersing tools S25N-25G for mixture volumes of 50–2500 ml and S25N-10G for mixture volumes of 1–50 ml; these two tools have the same emulsion "fineness" ratings. Immediately after the disperser was stopped, 25 ml of the mixture was transferred into a 25-ml graduated cylinder. The cylinder was sealed to prevent liquid evaporation, and the sediment volume was recorded as a function of time. Low sediment volumes indicate an effective dispersant and a stable dispersion. In the Tables, "weight %" refers to the weight percent of dispersant, based on inorganic particulate.

The test used to determine "filterability" in the Examples measured the quantity of the dispersant slurry, under 80 psi (550 kilopascals) pressure, which passed through a screen having a 12-micron pore size until the screen became completely plugged. The test apparatus consisted of a metal pipe, 1.75" (4.4 cm) in diameter and 18" (46 cm) long, threaded on each end, which was held in a vertical orientation. The lower end of the pipe was sealed with a metal cap having a 0.31" (7.9 mm) diameter opening in the center. Over this opening, between the cap and the pipe, were placed a set of 3 metal screens, of which the bottom was 20 mesh, the middle 200 mesh, and the uppermost was 200× 1400 mesh of Dutch Twilled Weave construction having an absolute retention rating of 11–13 microns, and a cardboard gasket having a 1" (2.54 cm) diameter opening. The gasket served to make a pressure-tight seal and to control the cross-sectional area through which the slurry flowed. The upper end of the pipe was sealed with a metal cap which was connected to a high pressure air line. The test was conducted by pouring 500 grams of the slurry of inorganic particulate, liquid, and dispersant into the pipe containing the screen pack and bottom cap, and then screwing on the top cap to make a tight seal. A valve was opened to apply 80 psi (550 kilopascals) air pressure to the apparatus, forcing the slurry to flow through the screens, and into a cup. When the flow had completely stopped, the quantity of slurry in the cup was weighed. The weight of slurry collected is a good prediction of the operating continuity of the spandex spinning process; the more slurry that was collected, the better was the operating continuity in dry spinning.

A Microtrac X100 (Honeywell, Leeds, and Northrup) instrument was used to measure D90, which is the particle size below which falls 90% of the volume of the particles in a sample.

Some specific examples of commercially available dispersants which are useful in the present invention are shown in Tables IA and IB; the information is based on information provided by the manufacturers; "CRN" means Chemical Registry Number. For the modified phosphated poly (alkyleneether) alcohols, where the average number of alkylene oxide units in the poly(alkyleneether) chain is known, it is indicated as "number EO" for ethylene oxide and as "number PO" for propylene oxide moieties.

The poly(alkyleneether) alcohols used for comparison purposes were either not phosphated or, if phosphated, were not modified with aromatic groups, alkylaromatic groups, or polyalkylsiloxane blocks, and, therefore, are outside the scope of this invention.

TABLE IA

| DISPERSANT | MANUFACTURER | CRN |
|---|---|---|
| (ALKYL) AROMATIC TERMINATED PHOSPHATED POLY (ALKYLENEETHER) ALCOHOLS | | |
| Sipophos P-6P | Spec. Ind. Prod. | 39464-70-5 |
| Chemphos TC-227 | Chemron Corp. | |
| Findet OJP-5 | Finetex, Inc. | 51811-79-1 |
| Monafax 785 | Uniqema | 51811-79-1 |
| Monafax 786 | Uniqema | 51811-79-1 |
| Sipophos NP-9P | Spec. Ind. Prod. | 51811-79-1 |
| Soprophor 3D-33 | Rhodia | 90093-37-1 |
| PHOSPHATED BLOCK POLY (ALKYLSILOXANE) -POLY (ALKYLENEETHER) ALCOHOLS | | |
| Lambent Phos A-100 | Lambent Technol. Corp. | 132207-31-9 |
| Lambent Phos A-150 | Lambent Technol. Corp. | 132207-31-9 |
| Lambent Phos A-200 | Lambent Technol. Corp. | 132207-31-9 |
| COMPARISON ALKYL TERMINATED PHOSPHATED POLY (ALKYLENEETHER) ALCOHOLS | | |
| Monafax 831 | Uniqema | 114733-04-9 |
| Sipophos DA-6P | Spec. Ind. Prod. | 52019-36-0 |
| Sipophos TDA-6P | Spec. Ind. Prod. | 73038-25-2 |
| COMPARISON PHOSPHATED POLY (ALKYLENEETHER) POLYOLS | | |
| Atphos 3232 | Uniqema | |
| Chemax X-1118 | Chemax, Inc. | 37280-82-3 |
| Solsperse 53095* | Avecia Pigments & Additives | 37280-82-3 |
| * 95% in water; obtained from United Color Technology, Inc. | | |
| COMPARISON POLY (ALKYLENEETHER) POLYOLS | | |
| Pluronic L-61 | BASF | 106392-12-5 |
| Pluronic F-68 | BASF | 106392-12-5 |
| Pluronic F-127 | BASF | 106392-12-5 |
| Pluronic 17R2 | EASF | 106392-12-5 |
| Pluronic 25R2 | BASF | 106392-12-5 |

TABLE IB

| DISPERSANT | CHEMICAL SYNONYMS |
|---|---|
| (ALKYL)AROMATIC TERMINATED PHOSPHATED POLY(ALKYLENEETHER) ALCOHOLS | |
| Sipophos P-6P | Phenyl-terminated poly(ethylenether) alcohol phosphate (6 EO) |
| Chemphos TC-227 | Aromatic-terminated poly(ethyleneether) alcohol phosphate (MW ca. 1000) |
| Findet OJP-5 | Nonylphenyl-terminated poly(ethyleneether) alcohol phosphate |
| Monafax 785 | Nonylphenyl-terminated poly(ethyleneether) alcohol phosphate (9.5 EO) |
| Monafax 786 | Nonylphenyl-terminated poly(ethyleneether) alcohol phosphate (6 EO) |
| Sipophos NP-9P | Nonylphenyl-terminated poly(ethyleneether) alcohol phosphate (9 EO) |
| Soprophor 3D-33 | Tristyrylphenyl-terminated poly(ethyleneether) alcohol phosphate (16 EO) |
| PHOSPHATED BLOCK POLY(ALKYLSILOXANE) POLY(ALKYLENEETHER) ALCOHOLS | |
| Lambent Phos A-100 | Block poly(dimethylsiloxane)-trimethylene-poly(ethyleneether) alcohol phosphate (MW ca. 3500; 7.5–8.3 EO) |
| Lambent Phos A-150 | Block poly(dimethylsiloxane)-trimethylene-poly(ethyleneether) alcohol phosphate (MW ca. 3500; 7 EO) |
| Lambent Phos A-200 | Bock poly(dimethylsiloxane)-trimethylene-poly(ethyleneether-co-propyleneether) alcohol phosphate (MW ca. 3500; random 7 EO + 4PO) |
| ALKYL TERMINATED PHOSPHATED POLY(ALKYLENEETHER)ALCOHOLS | |
| Monafax 831 | Isodecyl-terminated poly(ethyleneether) alcohol phosphate (10 EO) |
| Sipophos DA-6P | Isodecyl-terminated poly(ethyleneether) alcohol phosphate (6 EO) |
| Sipophos TDA-6P | Isotridecyl-terminated poly(ethyleneether) alcohol phosphate (6 EO) |
| COMPARISON PHOSPHATED POLY(ALKYLENEETHER) POLYOLS | |
| Atphos 3232 | Poly(ethyleneether) polyol phosphate |
| Chemax X-1118 | Poly(ethyleneether-co-propyleneether) polyol phosphate (MW ca. 8500) |
| Solsperse 53095 | Poly(ethyleneether-co-propyleneether) polyol phosphate |
| COMPARISON POLY(ALKYLENEETHER) POLYOLS | |
| Pluronic L-61 | Block poly(ethyleneether-co-propyleneether) polyol (MW 2000; 10 wt % EO; EO ends) |
| Pluronic F-68 | Block poly(ethyleneether-co-propyleneether) polyol (MW 8400; 80 wt % EO; EO ends) |
| Pluronic F-127 | Block poly(ethyleneether-co-propyleneether) polyol (Mw 12600; 70 wt % EO; EO ends) |
| Pluronic 17R2 | Block poly(propyleneether-co-ethyleneether) polyol (MW 2150; 20 wt % EO; PO ends) |
| Pluronic 25R2 | Block poly(propyleneether-co-ethyleneether) polyol (MW 3100; 20 wt % EO; PO ends) |

EXAMPLE I

The effect of several dispersants on the sedimentation behavior of Ultracarb® U5, an inorganic particulate, in DMAc was measured, and the results are reported in Table II. Sedimentation time was measured to the point when substantially no further change in sediment volume was observed.

TABLE II

| DISPERSANT | WEIGHT % | SEDIMENTATION TIME (hours) | SEDIMENT VOLUME (ml) |
|---|---|---|---|
| None | 0 | 70 | 16.0 |
| Soprophor ® 3D-33 | 8 | 69 | 6.7 |
| Lambent Phos ® A-150 | 8 | 89.75 | 6.8 |
| Lambent Phos ® A-200 | 8 | 89.5 | 6.8 |
| Solsperse ® 53095 | 8 | 68.8 | 7.0 |
| Lambent Phos ® A-100 | 8 | 69.5 | 7.5 |
| Chemphos ® TC-227 | 20 | 142.5 | 6.6 |
| Atphos ® 3232 | 20 | 142.25 | 6.6 |
| Findet ® OJP-5 | 20 | 164.25 | 6.7 |
| Monafax ® 785 | 20 | 119 | 6.7 |
| Chemax ® X-1118 | 20 | 70 | 10.8 |

All dispersants listed in Table II reduced sediment volume.

EXAMPLE II

The effect of various levels of selected dispersants on the sediment volume, measured at between 68 and 70 hours, of a 15 wt % mixture of Ultracarb® U5 in DMAc (based on weight of DMAc) is illustrated by the results reported in Table III.

TABLE III

| DISPERSANT | WEIGHT % | SEDIMENT VOLUME (ml) |
|---|---|---|
| Soprophor ® 3D-33 | 0 | 16.0 |
| " | 2.5 | 8.2 |
| " | 8 | 6.7 |
| " | 15 | 6.7 |
| " | 25 | 6.2 |
| Solsperse ® 53095 | 0 | 16.0 |
| " | 2.5 | 8.2 |
| " | 5 | 6.9 |
| " | 8 | 7.0 |
| " | 15 | 9.8 |
| " | 25 | 9.6 |
| Lambent Phos ® A-100 | 0 | 16.0 |
| " | 2 | 13.5 |
| " | 7.5 | 7.5 |
| " | 15 | 7.5 |
| " | 50 | 8.0 |

All three dispersants reduced sediment volume, when compared to samples without dispersant. FIG. 1 illustrates the sedimentation behavior of 15 wt % Ultracarb® U5 in DMAc without dispersant and in the presence of 7.5 wt % Lambent Phos® A-100 based on Ultracarb® U5. The effectiveness of the dispersant is evident from the much lower sediment volume than when the dispersant is absent.

EXAMPLE III

The effect of various levels of selected dispersants on the sediment volume of a 15 wt % mixture (based on weight of DMAc) of Ultracarb® UF in DMAc was tested, and the results are reported in Table IV. The sedimentation time for Soprophor® 3D-33 was 55–56 hours, that for Lambent Phos® A-100 was 70–71 hours, and that for Solsperse® 53095 was 77–79 hours, the latter dispersant outside of this invention.

TABLE IV

| DISPERSANT | WEIGHT % | SEDIMENT VOLUME (ml) |
|---|---|---|
| Soprophor ® 3D-33 | 0 | 12.0 |
| " | 2.5 | 9.4 |
| " | 5 | 7.3 |
| " | 8 | 7.6 |
| " | 15 | 9.2 |
| " | 25 | 17.4 |
| Lambent Phos ® A-100 | 0 | 12.0 |
| " | 2 | 11.6 |
| " | 5 | 8.0 |
| " | 8 | 7.4 |
| " | 15 | 8.4 |
| " | 25 | 12.0 |
| Solsperse ® 53095 | 0 | 12.0 |
| " | 2.5 | 12.4 |
| " | 5 | 8.3 |
| " | 8 | 7.5 |
| " | 15 | 9.1 |
| " | 25 | 10.4 |

Extrapolation of the results in Table IV indicates that with an inorganic particle size no larger than about one micron, sediment volumes were significantly reduced when the dispersant level was in the range of about 4–15 wt %, based on inorganic particulate.

When Lambent Phos® A-100 was used, the sediment volume continued to decrease somewhat after 70 hours, dropping to 6.2 ml at about 143 hours.

EXAMPLE IV

Four different types of Sipophos® dispersants, all soluble in DMAc and all phosphated poly(alkyleneether) alcohols but having different terminal hydrocarbon moieties, were tested by preparing 55–56 wt % Ultracarb® UF mixtures, based on weight of DMAc, and 7 wt % dispersant based on Ultracarb® UF and judging their viscosity qualitatively by observing their behavior when the mixtures were swirled and/or stirred. The results are presented in Table V, in which lower viscosity indicates a better dispersion.

TABLE V

| DISPERSANT | TERMINATION | VISCOSITY |
|---|---|---|
| Sipophos ® P-6P | aromatic | Low |
| Sipophos ® NP-9P | alkylaromatic | Medium |
| Sipophos ® DA-6P | alkyl | High |
| Sipophos ® TDA-6P | alkyl | High |

The data in this Table show the unexpected superiority of phosphated poly(alkyleneether) alcohol dispersants with aromatic termination (Sipophos® P-6P) or alkylaromatic termination (Sipophos® NP-9P) over those with alkyl termination (Sipophos® DA-6P TDA-6P), outside of this invention when used in the slurry of the invention.

EXAMPLE V

Other inorganic particulate materials were tested with Lambent Phose® A-100 at 15 wt % inorganic particulate content (based on weight of DMAc). The results are presented in Table VI.

TABLE VI

| INORGANIC PARTICULATE | WEIGHT % | SEDIMENTATION TIME hours | SEDIMENT VOLUME (ml) |
|---|---|---|---|
| Magnesium Carbonate | 0 | 118.1 | 10.0 |
| " | 8 | 141.3 | 6.2 |
| Magnesium Oxide | 0 | 117.9 | 22.2 |
| " | 8 | 141.1 | 4.4 |
| Titanium Dioxide | 0 | 119 | 15.0 |
| " | 8 | 237.4 | 3.0 |
| Zinc Oxide | 0 | 118.7 | 16.0 |
| " | 8 | 237.2 | 3.0 |
| Synthetic Hydrotalcite | 0 | 118.5 | 25.2 |
| " | 8 | 94.6 | 11.1 |

Comparison of sediment volume with no dispersant to that with 8 wt % dispersant based on inorganic particulate shows that Lambent Phos® A-100 is an effective dispersant in DMAc for a variety of inorganic particulate materials.

EXAMPLE VI (Comparison)

Sedimentation tests were performed on 15 wt % Ultracarb® U5 (based on weight of DMAc), using 10 wt % (based on weight of Ultracarb® U5) of several nonionic polyether dispersants in the Pluronic® series. These dispersants are soluble in DMAc. The results are reported in Table VII.

TABLE VII

| DISPERSANT | SEDIMENT TIME (hours) | SEDIMENT VOLUME (ml) |
|---|---|---|
| None | 65 | 17.0 |
| Pluronic ® L-61 | 90 | 16.0 |
| Pluronic ® F-68 | 64 | 17.5 |
| Pluronic ® F-127 | 64 | 17.5 |
| Pluronic ® 17-R | 64 | 16.5 |
| Pluronic ® 25-R | 64 | 17.0 |

The results show that poly(alkyleneether) alcohol dispersants which are not phosphated, outside the invention, are not effective dispersants of inorganic materials in DMAc. Even at 20 wt % dispersant based on inorganic particulates, similar results were obtained.

EXAMPLE VII

A dispersant slurry of the following composition was prepared by charging ingredients in the order listed into an agitated tank and mixing for 2 hours:

| | | | |
|---|---|---|---|
| DMAc | 81.1 | lbs. | (36.8 Kg) |
| KP-32 (20 wt % soln. in DMAc) | 49.0 | grams | |
| Lambent Phos ® A-100 | 8.8 | lbs. | (4.0 Kg) |
| Ultracarb ® UF | 101.5 | lbs | (46.0 Kg) |
| $TiO_2$ | 8.5 | lbs | (3.9 Kg) |

KP-32 is an anthraquinone dye used as a brightener and toner (Clariant Corp.). This slurry had an inorganic particulate (combined $TiO_2$ and Ultracarb® UF) level of 55 wt %. It was not necessary to add polyurethane solution for good milling performance. The dispersant was added before adding the inorganic particulates so that the slurry viscosity remained low.

The dispersant slurry was then milled in a 15-liter capacity horizontal media mill (Supermill model HM-15, Premier Mill Corp.) with 0.8–1.0 mm zirconium silicate beads being used as the milling medium. The bead loading was 83 volume %, shaft speed was 1380 rpm (disk peripheral speed 12.6 meters per second), and the product outlet temperature was maintained at 52° C. The mixture was milled at a flow rate of 1400 grams/minute in recirculation mode for 5 hours, and then finished with a final pass through the mill. Filterability according to the filtration test described above was 366 grams, and the D90 particle size was 0.57 micron.

This milled slurry was then combined with DMAc and polyurethane solution A in DMAc, using a Hockmeyer Model ES-25 (Hockmeyer Equipment Corp.) high speed disk disperser operated at 600–800 rpm. Polyurethane solution A contained 0.6 wt % silicone oil, 1.5 wt % Cyanox® 1790 (a hindered phenolic antioxidant [2,4,6-tris(2,6-dimethyl-4-t-butyl-3-hydroxybenzyl)-isocyanurate], Cytec Industries), 0.5 wt % Methacrol® 2462B [a polymer of (bis(4-isocyanatocyclohexyl)-methane) and 3-t-butyl-3-aza-1,5-pentanediol, DuPont] and 35.2 wt % (based on solution weight) polyurethane prepared from 1800 molecular weight poly(tetramethyleneether) glycol, 1,1'-methylenebis(4-isocyanatobenzene) (1.69 mole ratio of diisocyanate to polymeric glycol), a 90/10 mole ratio of ethylene diamine and 1,3-cyclohexanediamine chain coextenders, and diethylamine chain terminator. The polymer had a solution viscosity (40 degree falling ball) of approximately 3000 Poise. Except for the polymer weight percent, all weight percents listed for polyurethane solution A were based on the weight of final fiber.

The following proportions were used:

| | |
|---|---|
| Milled Slurry | 32.7 wt % |
| Polyurethane solution A | 44.6 wt % |
| DMAc | 22.7 wt % |

The resulting letdown slurry was then combined with the same polyurethane solution A in an amount so as to give 4.0 wt % Ultracarb® UF based on final fiber weight. The resulting spinning solution (containing suspended inorganic particulates) was dry spun into 3-filament, 44 dtex yarn using a solution temperature of 80° C. and a spinning head/spinneret face temperature of 435°–440° C. and wound up at 870 meters/min. During spinning, a small telescope with a video camera attached was focused on the spinneret face through a sight glass in the spinning cell in order to observe and record the formation of deposits at the outlet of the spinneret capillaries. Yarn was spun with excellent continuity for 6 days, and no deposits were observed on the spinneret face.

EXAMPLE VIII (Comparison)

A comparison slurry was prepared by mixing the following ingredients in the order listed:

| | |
|---|---|
| DMAc | 55.9 wt % |
| KP-32 (20% soln. in DMAc) | 0.026 wt % |
| Polyurethane solution B | 17.0 wt % |
| Ultracarb ® UF | 24.9 wt % |
| $TiO_2$ | 2.1 wt % |

Only about one-half of the inorganic particulate loading of Example VIII could be milled due to higher slurry viscosity; the total inorganic particulate (combined Ultracarb® UF and $TiO_2$) level was 27 wt %. Polyurethane solution B, necessary for adequate milling, was similar to polyurethane solution A of Example VIII but contained no additives. The mixture was then milled with two passes through a 45-liter capacity mill (Model HM-45, Premier Mill Corp.) at 200 lbs/hr (90.7 Kg/hr) at a disk peripheral speed of 12.6 meters per second. The product outlet temperature was 53° C. and the milling medium was zirconium silicate at 83% loading. In the first pass, 1.2–1.6 mm beads were used and, in the second pass, 0.8–1.0 mm beads were used. At this point the comparison slurry had been milled for about the same amount of time (30 minutes calculated hold-up time in the mill) as the slurry of Example VIII. The D90 particle size was 0.84 micron, and the filterability was 250 grams. This is to be compared with the 366 gram filterability observed in Example VIII.

This slurry was then further milled in the 15-liter mill in recirculation mode under the same milling conditions as in Example VIII. It required 8 hours of additional milling for the D90 particle size to reach 0.64 micron, at which time the comparison slurry was milled through in a final pass.

The comparison starting slurry was then let down by mixing 2 parts by weight of the slurry with 1 part of polyurethane solution A, using the same disk disperser as in Example VIII. The letdown slurry was added to polyurethane solution A as in Example VIII, and the resulting spinning solution (containing suspended inorganic particulates) was dry-spun into spandex as in Example VIII. Deposits were observed on the spinneret within one day, as was a higher frequency of spinning breaks.

EXAMPLE IX

Figure 2:
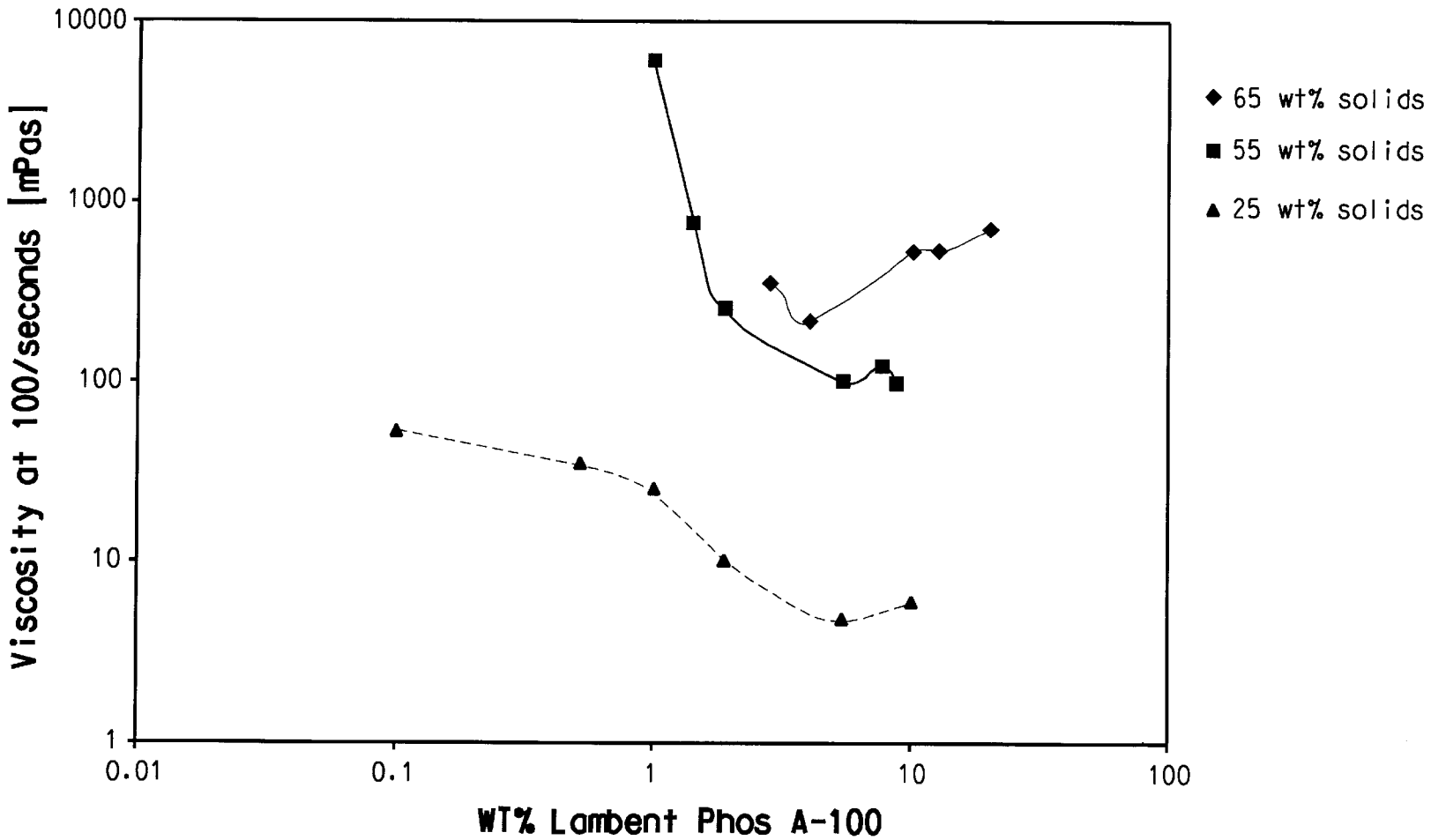
FIG. 2 illustrates the effect of various levels of a block copolymer of a phosphated poly(alkyleneether) alcohol with polymethylsiloxane on the viscosity of slurries of DMAc, a physical mixture of huntite and hydromagnesite and the block copolymer.

The effect of various levels of Lambent Phos® A-100 on slurry viscosity was tested at 25 wt %, 55 wt %, and 65 wt % Ultracarb® U5, based on weight of DMAc. A Haake RV20 rheometer with an M5 drive unit (Searle type; Haake GmbH, Germany) was used to measure the viscosity of selected slurries of the invention. The tests were run using 3 different cup and rotor combinations (NV, MV1, SV1P), each suitable for a different viscosity range. Each sample was shaken and hand mixed with a spatula until it was of uniform consistency and then loaded into the rheometer cup. The cup was placed in position between the rotor and the constant temperature jacket. The sample was held until it reached an equilibrium temperature of 25° C., as measured with a 1/16-inch (1.6 mm) thermocouple inserted into the slurry, and then the shear rate was increased from zero to 300 reciprocal seconds (only up to 100 reciprocal seconds for the 65 wt % solids sample) and back to zero in a 4-minute span. The corresponding shear stress was measured and automatically plotted. The shear stress vs. shear rate curve was then matched to a "best fit" mathematical curve using "Rot 3.0" software (also from Haake) and plotted. Viscosity was calculated by dividing the shear stress by the shear rate, the latter chosen to be 100 reciprocal seconds. Viscosity was then plotted against weight percent dispersant for several total solids levels to give the semi-logarithmic plot of FIG. 2. It can be seen that about 2–15 wt % dispersant, based on weight of inorganic particulate, depressed the viscosity of the slurry to levels which were judged processible and, therefore, allowed the use of higher solids contents than when the dispersant was not used.

EXAMPLE X

A sedimentation test was conducted using 15 wt % "Micro" grade blanc fixe (barium sulfate) based on weight of DMAc and 8 wt % Lambent Phos A-100 based on weight of barium sulfate. The barium sulfate in the sample not containing dispersant exhibited "structural" sedimentation (decreasing sediment volume with time), and the mixture containing dispersant and barium sulfate exhibited so-called "free" sedimentation, in which the volume of the sediment increases with time. Neither the dispersed nor the non-dispersed mixture showed additional changes in sediment volume after 22 hours after agitation. At that time, the slurry without dispersant had a sediment volume of 5.1 $cm^3$, and the slurry of this invention had a sediment volume of 2.5 $cm^3$.

EXAMPLE XI

Using N-methylpyrrolidone ("NMP") as the liquid amide, a sedimentation test was conducted with 15 wt % Ultracarb® UF based on weight of NMP and 8 wt % Lambent Phos A-100 based on weight of inorganic particulate. In the presence of dispersant, the sediment volume was 9.5 $cm^3$ after 167 hours, and in the absence of dispersant, the sediment volume was 17.8 $cm^3$ after 168 hours, indicating that the dispersant was effective in NMP as well as in DMAc.

EXAMPLE XII

Sedimentation tests were performed on 15 wt % Ultracarb® UF (based on weight of DMAc), using 8 wt % (based on weight of Ultracarb® U5) of magnesium stearate (Pfaltz & Bauer, Inc.) or stearic acid (Aldrich Chemical Company, Inc.). The results are shown in Table VIII.

TABLE VIII

| DISPERSANT | SEDIMENTATION TIME (hours) | SEDIMENT VOLUME (ml) |
|---|---|---|
| Magnesium stearate | 71.8 | 17 |
| Stearic acid | 72.0 | 16 |

Comparison of the results in Table VIII with those in Table IV, for example, shows that carboxylic acids and their salts are not good dispersants in the present system, since they gave results which were worse than those obtained even in the absence of dispersant.

Additional experiments showed that a mixture of huntite and hydromagnesite onto which stearic acid had been precoated formed slurries in DMAc which were more viscous than when stearic acid was not present. Similar results were observed when citric acid, outside the invention, was included in a slurry for use in making spandex.

EXAMPLE XIII

The viscosities of several slurries of the following compositions were compared:

TABLE IX

| Slurry A | | Slurry B (Comparison) | |
|---|---|---|---|
| DMAC | 200.7 grams | DMAC | 200.7 grams |
| Lambent ® Phos A-100 | 14.3 grams | Sipohos ® TDA-6P | 14.3 grams |
| Ultracarb ® UF | 285.0 grams | Ultracarb ®UF | 285.0 grams |
| Total | 500.0 grams | Total | 500.0 grams |

TABLE IX-continued

| Slurry C | | Slurry D (Comparison) | |
|---|---|---|---|
| DMAC | 132.5 grams | DMAC | 132.5 grams |
| Lambent ® Phos A-100 | 17.5 grams | Sipohos ® TDA-6P | 17.5 grams |
| TiO2 | 350.0 grams | TiO2 | 350.0 grams |
| Total | 500.0 grams | Total | 500.0 grams |

Each slurry was prepared by dissolving the dispersant in DMAc, adding the inorganic particulate slowly with stirring (propeller agitator), stirring the slurry for another 15 minutes, and then allowing it to stand without stirring for 4 days. Ultracarb® UF was 57 wt %, based on total slurry, titanium dioxide (Ti-Pure® R902, a registered trademark of E. I. du Pont de Nemours and Company) 70 wt %, based on total slurry. The slurries were shaken to redisperse any settled solids, and their viscosity was measured using a Brookfield Model RT-TDV-II viscometer at 19° C. at 5 rpm. Due to the large differences in the viscosities, those of Slurries A and C were determined with spindle #2, and those of Slurries B and D with spindle #6. Viscosities and qualitative observations are given in Table X.

TABLE X

| Slurry | Viscosity (Poise) | Observation |
|---|---|---|
| A | 23 | Flowable, pourable liquid. |
| B (Comparison) | 541 | Thick nonflowable, nonpourable. |
| C | 8.1 | Very thin, flowable, pourable liquid. |
| D (Comparison) | 284 | Thick cream; nonflowable, nonpourable. |

The results in Table X show that phosphated block poly (methylsiloxane)-poly(alkyleneether) alcohols such as Lambent® Phos A-100 are unexpectedly superior in making useful, flowable slurries of the invention, when compared to the slurries made with alkyl-terminated phosphated poly (alkyleneether) alcohol dispersants such as Sipophos® TDA-6P (unacceptably high viscosity and poor flow characteristics).

What is claimed is:

1. A dispersant slurry consisting essentially of:

(A) 10–78 wt %, based on the total weight of the dispersant slurry, of an inorganic particulate;

(B) 2–50 wt %, based on the inorganic particulate, of a dispersant soluble in the liquid of component (C) selected from the group consisting of (i) phosphated block poly(alkylsiloxane)-poly (alkyleneether) alcohols; and (ii) aromatic- or alkylaromatic-terminated phosphated poly(alkyleneether) alcohols; and (C) a liquid selected from the group consisting of dimethylsulfoxide, tetramethylurea, and amides.

2. The slurry of claim 1 comprising 10–70 wt % inorganic particulate, wherein the dispersant is selected from the group consisting of phosphated block poly(alkylsiloxane)-trimethylene-poly(alkyleneether) alcohols and aromatic-terminated phosphated poly(alkyleneether) alcohols, the inorganic particulate has a median particle size, based on volume distribution, of ≦5 microns, and the liquid is an amide selected from the group consisting of N-methylpyrrolidone, dimethyl acetamide, and dimethyl formamide.

3. The dispersant slurry of claim 1 wherein said dispersant is selected from the group consisting of: aromatic-terminated phosphated poly(alkyleneether) alcohols, and alkylaromatic-terminated phosphated poly(alkyleneether) alcohols.

4. The dispersant slurry of claim 1 wherein said dispersant is a phosphated block poly(alkylsiloxane) poly (alkyleneether) alcohol.

5. The dispersant slurry of claim 1 wherein said dispersant is 2–25 wt % based on the weight of inorganic particulate.

6. The dispersant slurry of claim 1 wherein said inorganic particulate is about 35–70 wt % based on total weight of the dispersant slurry.

7. The dispersant slurry of claim 1 wherein said inorganic particulate has a mean particle size, based on volume distribution, of about one micron or less.

8. The slurry of claim 1 wherein the inorganic particulate is selected from the group consisting of titanium dioxide, zinc oxide, magnesium oxide, aluminum oxide, magnesium carbonate, calcium carbonate, barium carbonate, synthetic hydrotalcite, natural hydrotalcite, calcium sulfate, barium sulfate, and a physical mixture of huntite and hydromagnesite, and the liquid amide is selected from the group consisting of N-methylpyrrolidone, dimethyl acetamide, and dimethyl formamide.

9. The slurry of claim 8 comprising 35–70 wt % inorganic particulate, wherein the dispersant is phosphated block poly (methylsiloxane)-trimethylene-poly (alkyleneether) alcohol and is present to the extent of about 4–15 wt % based on inorganic particulate, and the inorganic particulate has a median particle size, based on volume distribution, no larger than about one micron.

* * * * *